United States Patent [19]

Lee

[11] Patent Number: 5,015,175

[45] Date of Patent: May 14, 1991

[54] MELODIC CANDLE ASSEMBLY

[76] Inventor: Che-Cheol Lee, No. 305, 119-dong, Chugong A.P.T., Gayemjong-dong, Changwon, Rep. of Korea

[21] Appl. No.: 590,942

[22] Filed: Oct. 1, 1990

[30] Foreign Application Priority Data

Oct. 11, 1989 [KR] Rep. of Korea ..... 89-15001

[51] Int. Cl.[5] ..... F23D 3/16

[52] U.S. Cl. ..... 431/253; 431/289

[58] Field of Search ..... 431/253, 289

[56] References Cited

U.S. PATENT DOCUMENTS 4,477,249 10/1984 Ruzek et al. ..... 431/253

4,568,269 2/1986 Lin ..... 431/253

4,804,323 2/1989 Kim ..... 431/253

*Primary Examiner*—Carroll B. Dority

*Attorney, Agent, or Firm*—Edward H. Loveman

[57] ABSTRACT

A melodic candle assembly having a generally cylindrical wax body seated in the top of a tubular base. The wax body has an axial wick. Adjacent the wick is a thermoresponsive member comprising a thin piezoelectric strip with metal films on opposite sides thereof which serve as electrodes. An electronic circuit in the base has an integrated circuit comprising a memory stage containing prerecorded signals representing audible sounds. A loudspeaker in circuit with the memory stage reproduces the audible sounds when activated. The thermoresponsive member is connected to the electronic circuit and applies thereto a piezoelectrically generated voltage when the candle is ignited to thereby trigger the memory stage and activate the loudspeaker. When the candle flame is extinguished, the audible sounds are stopped.

10 Claims, 1 Drawing Sheet

FIG. 1
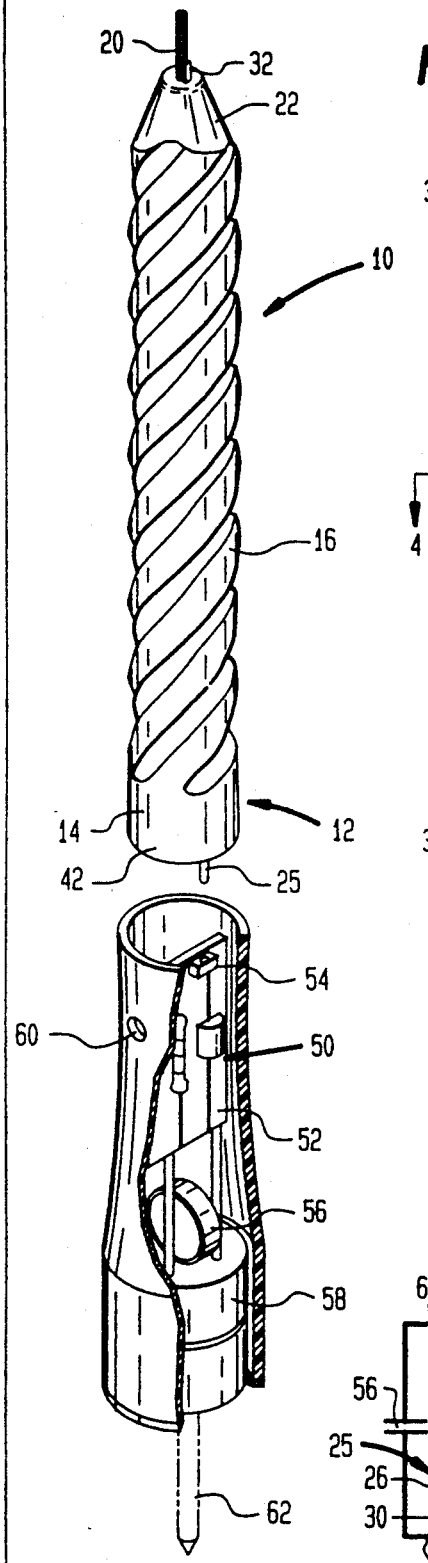
FIG. 4
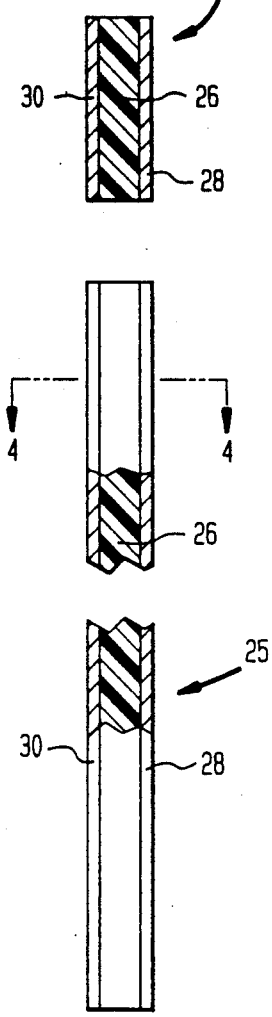
FIG. 3
FIG. 2
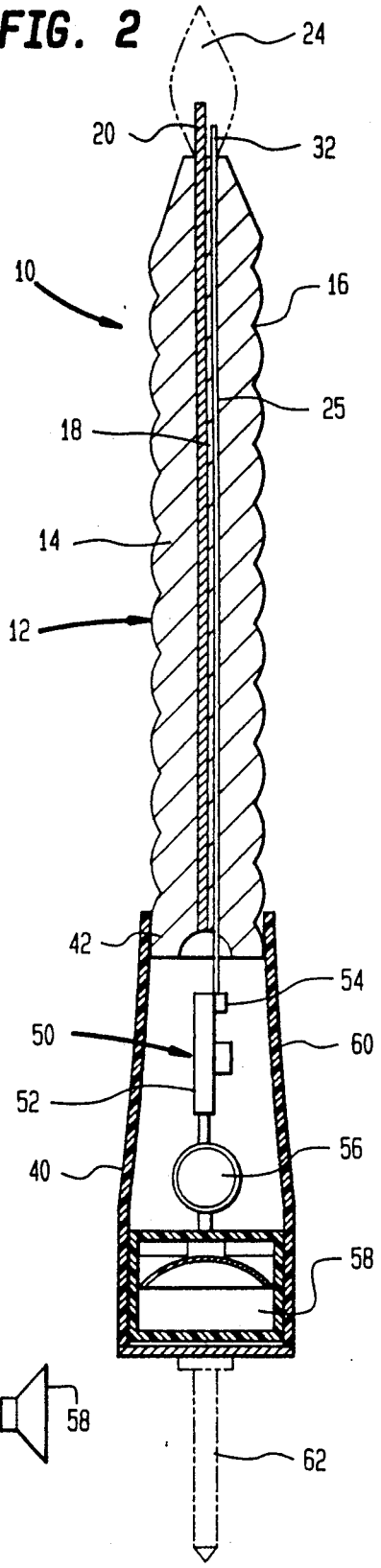
FIG. 5
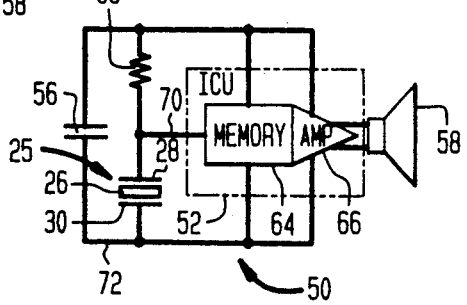

MELODIC CANDLE ASSEMBLY

BACKGROUND OF THE INVENTION

1. Field of the Invention

This invention relates to the art of festive candles used on cakes and other objects for celebrating red-letter days such as birthdays, anniversaries, parties, engagements, holidays, retirements, etc.; and more particularly concerns a festive candle assembly which emits an audible melody, musical tones, vocal rendition, song or spoken message when the candle is ignited and which ceases emitting audible sounds when the candle flame is extinguished.

2. Description of the Prior Art

Conventional candles used on cakes for festive occasions are generally cylindrical or tapered bodies of wax, tallow, or other solid fat with a an axial wick which is lighted to produce a flame of low intensity when burning. Such candles burn silently. Since they emit no sound they do not enhance the festivity of the occasion melodically.

SUMMARY OF THE INVENTION

According to the invention there is provided a candle made of wax in which is an axial wick. Adjacent the wick is a thermoresponsive member comprising a thin strip of piezoelectric material. On opposites sides of the thin flat strip are two thin electrically conductive films which serve as electrodes for the piezoelectric strip. The thermoresponsive member extends over the entire length of the candle and projects above and below the ends of the candle. The upper end of the member is disposed adjacent the tip of the wick. As the wick tip burns along the wax body, the thermoresponsive member burns down at the same rate so its upper end is always disposed adjacent the unburned wick. The lower end of the piezoelectric member projects downwardly from the bottom of the candle which seats in a tubular base. The lower end of the piezoelectric member is connected to an electronic circuit in the base of the candle. This circuit includes an integrated circuit unit which has a memory stage in which is recorded the melody, song or vocal rendition to be reproduced. The memory stage is connected to the input of an amplifier which drives a miniature loudspeaker. When the wick of the candle is ignited, the candle flame heats the exposed tip of the thermoresponsive member. The piezoelectric strip reacts conventionally to the candle flame temperature to produce internal mechanical stresses which generates a voltage piezoelectrically across the piezoelectric strip. This voltage is conveyed to the memory stage of the circuit and triggers the memory stage to energize the amplifier and activate the loudspeaker. When the flame is extinguished, the generation of audible sound stops. If the candle is not fully consumed, it may be reignited and the candle assembly will continue to emit the preprogrammed sounds as long as the candle flame burns.

It is therefore a principal object of the present invention to provide a melodic candle assembly which enhances the festivity of a celebration or other happy occasion by emitting a melody or other pleasant sounds when the wick is ignited and which becomes silent when the candle flame is extinguished.

Another object of the present invention is to provide a candle for a birthday cake or the like that emits a prerecorded melody or message when lighted, which is decorative in appearance, and which resembles a conventional candle in size, shape and external appearance.

BRIEF DESCRIPTION OF THE DRAWINGS

These and other objects and many of the attendant advantages of this invention will be readily appreciated as the same becomes better understood by reference to the following detailed description when considered in connection with the accompanying drawings in which:

FIG. 1 is an exploded perspective view of parts of the candle assembly, portions of the assembly being broken away to show internal construction;

FIG. 2 is an axial section view of the candle assembly;

FIG. 3. is a side elevational view on a greatly magnified scale of the thermoresponsive member, parts being omitted and parts being shown in vertical section;

FIG. 4 is a cross sectional view taken along line 4—4 of FIG. 3; and

FIG. 5 is a diagram of the electronic circuit employed in the candle assembly.

DESCRIPTION OF THE PREFERRED EMBODIMENT

Referring now to the drawings, wherein like reference characters designate like or corresponding parts throughout, there is illustrated in FIGS. 1 and 2 a melodic candle assembly generally designated as reference numeral 10, which comprises a candle 12 having a general cylindrical body 14 made of paraffin wax, tallow or other solid fat. The body 14 is both meltable and combustible and has external fluting or grooves to provide a decorative, ornamental appearance. Extending axially through the body 14 is a combustible wick 18 having a wick tip 20 extending out of an upper end 22 of the body 14 where it can be ignited to create and maintain a flame 24 as illustrated by dotted lines in FIG. 2.

Extending axially of the body 14, and slightly spaced from the wick 18, is a thermoresponsive member 25. As best illustrated in FIGS. 3 and 4, the member 25 is comprised of a long thin flat piezoelectric strip 26 of dielectric material. On opposite sides of the strip 26 are thin electrically conductive films 28 and 30 which serve as electrodes across which a voltage is developed when the strip 26 is mechanically stressed. The member 25 has a short tip 32 which extends above the top end 22 of the body 14 adjacent to the wick tip 20.

A base 40, which is a plastic tube, has an open top into which a bottom end 42 of the body 14 seats snugly to hold the candle body 14 in axially upright position. Inside of the base 40 is an electronic circuit 50, which comprises an integrated circuit unit (ICU) 52, on the front of which is a socket 54 into which the lower end of the member 25 engages to apply the piezoelectrically generated voltage to the circuit 50. An electrically actuated loudspeaker 58 is located at the bottom of the base 40 which is enlarged to accomodate the loudspeaker 58 and to stabilize the assembly in upright position. Holes 60 in the base 40 serve to pass audible sound waves from the loudspeaker 58 to the ambient surroundings. If desired a pin or peg 62 shown in dashed lines in FIGS. 1 and 2 may ne secured to the bottom of the base 40 (or molded integrally therewith) to hold the assembly 10 upright on a cake, polystyrene block or other support.

The circuit illustrated in FIG. 5, includes a battery 56 which provides the primary source of power for the circuit 50. The ICU 52, has a memory stage 64 connected to an amplifier stage 66 which drives a loudspeaker 58. The battery 56 has a voltage dropping resistor 68 connected across the memory stage 64. In series with the resistor 68 is the thermoresponsive member 25 whose electrode 28 is connected to the memory stage 64 via an input line 70 and whose electrode 30 is connected to the battery 56 and a ground line 72. When the piezoelectric strip 26 generates a voltage upon being mechanically stressed, the voltage is applied via the electrodes 28 and 30 to the memory stage 64 to trigger it to release prerecorded pulses representing sound signals such as a melody, pleasant musical tones, a vocal rendition, or a spoken message.

In operation of the assembly 10, the user mounts the candle assembly in an upright position on a cake or other support. The user then ignites the wick tip 20 to create the flame 24 which heats the upper end of the member 25. The heat from the flame 24 causes the upper end of the member 25 to melt and generate internal stresses in the piezoelectric member and thereby generate a voltage across the strip 26 between the electrodes 28 and 30. This voltage triggers the integrated circuit unit 52 to apply prerecorded pulses representing sounds to the amplifier stage 66 to drive the loudspeaker 58. The loudspeaker 58 reproduces musical tones, a melody, a song, spoken words or other sounds. As the candle wick 18 and the candle body 14 burn down, the tip of the member 25 burns down at the same rate, so there is always an unburned upper part of the member 25 adjacent to the wick tip 20. It is this unburned part which is heated by the flame 24 which produces the piezoelectric voltage across the electrodes 28, 30. When the candle flame 24 is extinguished no piezoelectric generated voltage is applied to the circuit 50 and the sounds emitted by the loudspeaker 58 cease. If the candle body 14 is not completely burned away, the candle assembly 10 may be reignited and the heat from the flame 24 will again be applied to the tip 32 to generate the piezoelectric voltage for activating the circuit 50 and generating the audible sounds via the loudspeaker 58.

The several parts of the integrated circuit unit 64 are conventional and within the current state of the art so no further description is required here concerning the details or logic of the circuit. Furthermore such details are outside the scope of the present invention.

The strip 26 of the thermoresponsive member 25 is made of a synthetic resin ceramic, or other material which exhibits piezoelectric properties. If desired powered piezoelectric material, such as ground quartz may be added to the composition of the strip 26 to enhance the piezoelectric effect. A combustion resistant material such as polyvinyl chloride or other substance may be added to the composition of the strip 26 to preset its burning rate to equal that of the wick 18 and candle body 14, whereby the upper end 32 of the member 25 is always exposed adjacent the unburned tip 20 of the wick 18. The electrodes 28, 30 can be composed of highly conductive metal such as aluminum or copper.

In one practical embodiment of the invention, the overall length of the candle assembly is 4.5 inches. The candle body 14 is about three inches long and approximately 0.3 of an inch in diameter. The wick 18 is about one sixteenth of an inch in diameter. The thermoresponsive member 25 is about 0.10 of an inch in thickness and about 3/32 inches in cross sectional width. The piezoelectric strip is about 0.008 of an inch in thickness and the electrodes 28, 30 are each about 0.001 of an inch in thickness.

The candle assembly described can be readily manufactured by mass production machinery at minimum cost. The candle assembly requires no skill to operate and no tools are required. When the candle body is partially or wholly burned up it can be discarded. The assembly is so inexpensive that the consumer can purchase and use many candle assemblies each having a different prerecorded song or melody suitable for different occasions such as birthdays, wedding anniversaries, Christmas parties, engagements, children's parties, and celebrations occuring all during the year. The candle assemblies will give great satisfaction because they enhance the festivity of every occasion by emitting sounds appropriate to the occasion.

It should be understood that the foregoing relates to only a preferred embodiment of the invention which has been by way of example only, and that it is intended to cover all changes and modifications of the example of the invention herein chosen for the purposes of the disclosure, which do not constitute departures from the spirit and scope of the invention.

What is claimed is:

1. A melodic candle assembly, comprising:

a generally cylindrical solid body made of a meltable and combustible material, said body having a top and a bottom end;

a combustible wick extending axially through said body and having a wick tip extending from said top end of said body for conveying melted material from said body to feed a flame maintained at said wick tip when said wick tip is ignited, a long thin thermoresponsive member parallel and close to said wick, said member having a top end adjacent to said wick tip to be heated by said flame, said member having a lower end extending below said bottom end of said body, said member being responsive to heating of said top end thereof by said flame to produce a voltage at said lower end;

support means for holding said body in an axially upright position; and an electronic circuit means enclosed by said support means, said lower end of said member being connected to said circuit means for applying said voltage thereto, said circuit means including audio frequency reproduction means for audibly reproducing prerecorded audible tones therefrom when said voltage is applied thereto whereby said audible tones are produced when said flame heats said top end of said member, and said audible tones cease when said flame is extinguished.

2. A melodic candle assembly as claimed in claim 1 wherein said thermoresponsive member extends axially through said body.

3. A melodic candle assembly as claimed in claim 1, wherein said thermoresponsive member comprises a long thin piezoelectric strip with thin electrically conductive electrodes on opposite sides of said strip, said piezoelectric strip being responsive to heating by said flame at its upper end to generate said voltage between said electrodes.

4. A melodic candle assembly as claimed in claim 1 wherein the composition of said member is such that it burns at the same rate as said wick and said body so that said wick tip and said top end of said member are always adjacent to each other.

5. A melodic candle assembly as claimed in claim 1 wherein said audio frequency reproduction means comprises:

an integrated circuit unit in which are stored prerecorded signals representing audible sounds; and a loudspeaker connected to said integrated circuit unit for reproducing said prerecorded signals audibly when said voltage is applied to said integrated circuit unit.

6. A melodic candle assembly as claimed in claim 1 wherein said support means comprises a tubular base having an open top, said bottom end of said body seating snugly in said open top of said base, said electronic circuit means being located in said base below said bottom end of said body.

7. A melodic candle assembly as claimed in claim 6 wherein said thermoresponsive member extends axially through said body.

8. A melodic candle assembly as claimed in claim 7 wherein said audio frequency reproduction means comprises:

an integrated circuit unit in which are stored prerecorded signals representing audible sounds; and a loudspeaker connected to said integrated circuit unit for reproducing said prerecorded signals audibly when said voltage is applied to said integrated circuit unit.

9. A melodic candle assembly as claimed in claim 8 wherein said thermoresponsive member comprises a long thin piezoelectric strip with thin electrically conductive electrodes on opposite sides of said strip, said piezoelectric strip being responsive to heating by said flame at its upper end to generate said voltage between said electrodes.

10. A melodic candle assembly as claimed in claim 9 wherein the composition of said member is such that it burns at the same rate as said wick and as said body so that said wick tip and said top end of said member are always adjacent to each other.

* * * * *